US005195216A

United States Patent [19]

Ishii

[11] Patent Number: 5,195,216

[45] Date of Patent: Mar. 23, 1993

[54] HOOKING CLASP FOR A CORD-LIKE THING

[75] Inventor: Shozo Ishii, Kobe, Japan

[73] Assignee: Yoko Kuramatsu, Kobe, Japan

[21] Appl. No.: 791,538

[22] Filed: Nov. 14, 1991

[30] Foreign Application Priority Data

Nov. 30, 1990 [JP] Japan ..... 2-341258

[51] Int. Cl.[5] ..... A44B 17/00

[52] U.S. Cl. ..... 24/18; 24/3 M; 24/129 A

[58] Field of Search ..... 24/18, 19, 115 R, 129 R, 24/129 A, 300, 301, 302, 712.9, 511, 515, 499, 5, 6, 67.3, 67.9, 507, 501

[56] References Cited

U.S. PATENT DOCUMENTS

| | | | |
|---|---|---|---|
| 304,349 | 9/1884 | Munroe | 24/712.9 |
| D. 309,207 | 7/1990 | Sporer | 24/507 |
| 666,400 | 1/1901 | Tregoning | 24/129 A |
| 800,050 | 9/1905 | Ayres | 24/129 A |
| 886,905 | 5/1908 | Ward | 24/18 |
| 1,114,014 | 10/1914 | Miller | 24/18 |
| 1,432,808 | 10/1922 | Thiemann | 24/18 |
| 1,526,867 | 2/1925 | Peterson | 24/3 M |
| 1,598,704 | 9/1926 | Bosse | 24/18 |
| 1,887,491 | 11/1932 | Johnson | 24/3 M |
| 2,188,750 | 1/1940 | Hacker | 24/18 |
| 2,573,125 | 10/1951 | Wilks | 24/511 |
| 2,660,826 | 12/1953 | Bennett | 24/6 |
| 2,879,567 | 3/1959 | O'Connell | 24/5 |
| 3,060,530 | 10/1962 | Harvey | 24/67.3 |
| 3,167,329 | 1/1965 | Ernst | 24/67.3 |
| 4,100,316 | 7/1978 | Lackey | 24/5 |
| 4,648,159 | 3/1987 | Dougherty | 24/18 |
| 4,991,269 | 2/1991 | Kuroda | 24/67.9 |

FOREIGN PATENT DOCUMENTS

| | | | |
|---|---|---|---|
| 0486276 | 11/1929 | Fed. Rep. of Germany | 24/18 |
| 0125894 | 5/1928 | Switzerland | 24/18 |
| 0016580 | of 1887 | United Kingdom | 24/712.9 |
| 0007111 | of 1895 | United Kingdom | 24/712.9 |

*Primary Examiner*—Victor N. Sakran

*Attorney, Agent, or Firm*—Birch, Stewart, Kolasch & Birch

[57] ABSTRACT

A hooking clasp for a cord-like member is provided which can simply and securely bind objects and furthermore, can be used repeatedly. The hooking clasp of the invention has a structure in which two elastic flat plates are fixed at their center portions, and a cord-like member such as a cord or rope is inserted into a gap formed between the flat plates and is hooked and wound on the fixed center portion for being pinched by the flat plates. An alternative hooking clasp of the invention has a structure in which an annular ring-shaped holding groove having almost the same width as a diameter of the cord-like member is engraved on a periphery of a cylindrical body and the cord-like member is hooked and wound for securement on the holding groove.

5 Claims, 2 Drawing Sheets

HOOKING CLASP FOR A CORD-LIKE THING

BACKGROUND OF THE INVENTION

1. Field of the Invention

This invention relates to a hooking clasp for a cord-like thing with which the cord-like thing can be easily and surely hooked up and wound and clasped.

2. Description of Related Art

Conventionally, when bundling articles, for example, the articles were wound many times with a cord or rope, whose ends were tied up together. When using a tape to close a case's lid, the tape was stuck to the case.

Furthermore, in order to bundle things easily, a rubber band is used, but a rubber band has a disadvantage of winding it many times by twisting it to fasten things. For example, when holding and bundling an electric cord, using a rubber band, a tight bundle can not be obtained unless the folded cord passes the rubber band many times. While, a vinyl chloride fastener is sometimes appended, but it is rarely used because it is troublesome in handling and this vinyl chloride fastener is treated as useless.

Furthermore, when tying up hair with a rubber band, the hair can not be easily tightened with a rubber band, and when removing the rubber band, the hair hangs about the rubber band and is difficult to remove from the band.

When handling a large package, there is a method of fastening a band around the package using a binding device. Although this band fastening method using a binding device is frequently used such a device is only applicable for a single use.

That is to say, bundling things often requires extensive and troublesome labor and time.

As mentioned above, for binding articles, winding, fastening and tying are necessary in using a cord or rope, or winding and fastening with a rubber band are effected. In these cases, it is difficult to wind or unwind the cord, rope or the band, and these processes are troublesome. Therefore, there is a long-felt need for development of a hooking clasp for a cord-like thing which can be easily and surely used for these processes and reused many times.

SUMMARY OF THE INVENTION

In view of the above situations, the present invention provides a structure in which a pair of elastic flat plates are fixed at their center portion and a cord-like member such as a cord or rope is inserted into the gap between the two flat plates and wound onto a fixed portion to be clasped by the plates.

The present invention has further created a structure in which an annular ring-shaped holding groove which has substantially the same width as a diameter of the cord-like member is engraved on a periphery of a cylindrical body to wind the cord-like member into the holding groove to hold it.

In addition, the present invention includes a structure in which a flat plate or a cylindrical body is provided with a snap fastener, and a flat plate or a cylindrical body is equipped with a snap via a connecting piece, and this hooking clasp is always ready to be installed on binding objects for use.

The present invention determines dimensions and shapes of the gap between the flat plates or the holding groove of the cylindrical body so that they can be most easily used for fastening the cord-like member and also the most resistant to use for loosening the same depending upon a thickness and shape of the cord-like member.

Furthermore, the present invention may be so used that it imparts a fashionable appearance to the hooking clasp by providing an ornament on the end surface of the flat plate or the cylindrical body.

Moreover, in order to make the portion of the flat plates or the cylindrical body on which the cord-like member is wound strong and resistant to loosening, a fixture that can strongly pinch or secure the portion of the wound cord-like member is provided at the portion.

As mentioned above, the hooking clasp of the present invention can securely clasp all articles having different dimensions and shapes by simple hooking and winding operations.

BRIEF DESCRIPTION OF THE DRAWINGS

FIGS. 1 through 7 are illustrative views showing one practical embodiment of a hooking clasp for a cord-like member of the present invention, wherein FIG. 1 is a sectional view of a hooking clasp for a cord-like member which uses flat plates;

FIG. 2 is a sectional view of a hooking clasp for a cord-like member which uses a cylindrical body;

FIG. 3 is a sectional view of a hooking clasp for a cord-like member which uses a snap attached to a flat plate;

FIG. 4 is a sectional view of a hooking clasp for a cord-like member which is provided with a snap at an end of a connecting piece extended from one flat plate;

FIG. 5 is a sectional view of a hooking clasp for a cord-like member which is provided with an ornament on a flat plate;

FIG. 6 is a sectional view of a hooking clasp for a cord-like member which is provided with fixing portions on flat plate surfaces; and FIG. 7 is a plan view showing a plurality of hooking clasps for a cord-like thing in a serial connection.

DETAILED DESCRIPTION OF PREFERRED EMBODIMENTS

One practical embodiment of the present invention will be explained in detail referring to the accompanying drawings.

Figure 1:
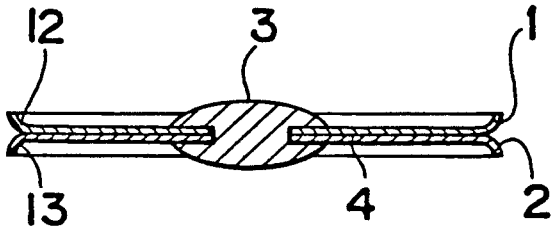

FIG. 1 shows a hooking clasp for a cord-like member which is comprised of a pair of layered flat plates.

Disklike flat plates 1 and 2 of an elastic metal sheet are coupled one on another and center portions 3 thereof are fixed by caulking, welding, bonding or the like, and a gap 4 is interposed between the flat plates 1 and 2 excepting the fixed center portion 3. A cord-like member (not shown) such as a cord or rope is inserted into the gap 4, and the cord-like member is pinched between the elastic flat plates 1 and 2. In addition, the peripheries of the flat plates 1 and 2 are formed into outwardly-open oblique sides 12 and 13 so that easy insertion of the cord-like member into the gap 4 is facilitated.

A starting end of the cord-like member is hooked and wound many times onto the fixed center portion 3 of the flat plates 1 and 2 to clasp the cord-like member, and a required object is bundled with the cord-like member and thereafter a terminal end of the cord-like member can be further hooked and wound onto the fixed center portion 3 to clasp the cord-like member.

Furthermore, the other end of the cord-like member, whose one end is fixed to the required object, is inserted between the flat plates 1 and 2 and hooked and wound onto the fixed center portion 3 to clasp the cord-like member. Even at this time, the cord-like member can be clasped by only hooking and winding the other end of the cord-like member onto the fixed center portion 3.

Figure 2:
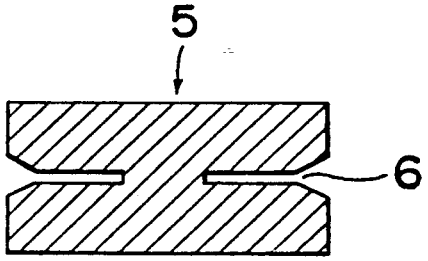

In FIG. 2, a holding grove 6 having almost the same width as the diameter of the cord-like member engraved on a periphery of a cylindrical body 5 is clasped by inserting itself into the holding groove 6 and hooking and winding it a number of times. In the illustrated example, the cylindrical body 5 is provided with only one holding groove 6, but may be equipped with a plurality of holding grooves.

Figure 3:
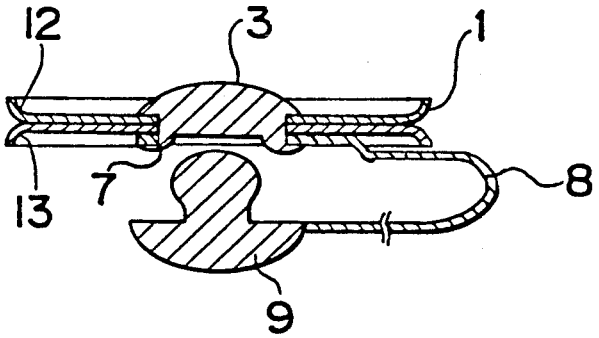

In FIG. 3, snap fastener 7 is provided in the center portion 3 of the flat plates 1 and 2 and a snap 9 is equipped via a connecting piece 8, and after passing the connecting piece 8 through the binding objects, the flat plates 1 and 2 are used by coupling the snap 9 to the snap fastener 7. In addition, the cylindrical body 5 may be provided with the snap fastener 7, connecting piece 8 and the snap 9 as mentioned above.

Figure 4:
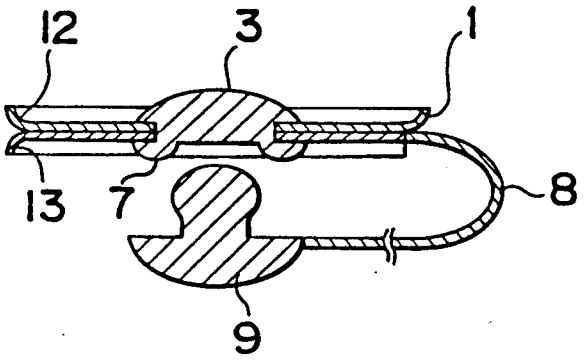

As shown in FIG. 4, the connecting piece 8 may be extended from one flat plate 2.

Still further, the connecting piece 8 may be equipped with a rubber band.

Figure 5:
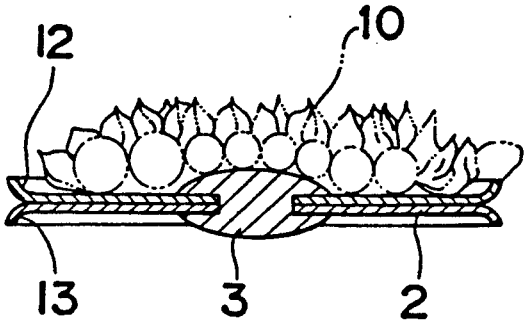

In FIG. 5, the flat plates 1 and 2 are provided with ornaments 10 for imparting a fashionable appearance, and, for example, this type of hooking clasp can be used for binding hair. Alternatively, an end surface of the cylindrical body 5 may be equipped with the ornament 10.

Figure 6:
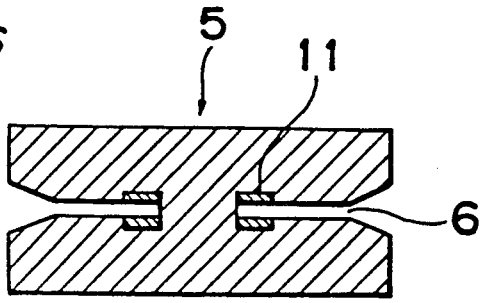

In FIG. 6, fixing portions 11 are provided so that a bound portion will not be loosened when binding things to the cylindrical body 5 with the cord-like member. This structure is used when the bound portion should not be easily loosened depending upon sizes of the object to be bound or binding positions. The fixing portion 11 is formed by inlaying an element such as a clamp. The fixing portion 11 can be provided on the flat plates 1 and 2 as well as in the cylindrical body 5.

Figure 7:
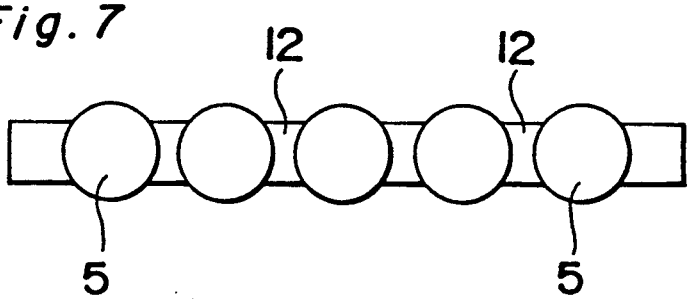

In FIG. 7, a plurality of the cylindrical bodies 5 are connected serially via connecting bands 12, and this configuration is used when a plurality of the cylindrical bodies 5 should be used simultaneously in series. Alternatively, a plurality of the flat plates 1 and 2 also may be arranged via the connecting bands 12. Still further, a plurality of the flat plates or cylindrical bodies may be used one on another.

The above-mentioned has explained examples which use the flat plates or the cylindrical bodies, but their shapes, sizes and materials are determined depending upon the nature of articles to be bound up, places where the hooking clasps are used and other conditions. The material used as the flat plate is preferably a strong elastic one, but resin, metal, non-ferrous metal, alloy, ceramic or the processed materials, or equivalents of the above materials or materials of like quality can be properly selected depending upon the material quality of the cord-like member or a material quality and shape of a member to be bound, an object of bundling, a place where the hooking clasp is used.

EFFECTS OF THE INVENTION

The present invention provides a structure in which a cord-like member is inserted into a gap formed between two flat plates or a holding groove formed on a periphery of a cylindrical body and is hooked and wound a number of times, and this simple operation enables the user to bundle all kinds of things in any place with ease, and the structure can be utilized for bundling small as well as large items and has a very wide range of applications, thereby saving resources and making better use of time.

I claim:

1. A hooking clasp comprising:

a pair of resilient plate each one of said pair of resilient plate members includes a substantially planar mating surface;

means for coupling said pair of plate members together at a central portion of each one of said pair of plate members, whereby the substantially planar mating surfaces of said pair of plate members are in surface contact;

a snap member connected to one of said pair of plate members by a connecting piece; and a male snap member connected to an opposing end of the connecting piece, wherein said means for coupling is a female snap member for receiving the male snap member therein.

2. The hooking clasp according to claim 1, wherein said pair of resilient plate members are integrally connected to said means for coupling.

3. The hooking clasp according to claim 1, wherein said pair of resilient plate members are of a one-piece construction with said means for coupling.

4. The hooking clasp according to claim 1, wherein peripheral edges of said pair of plate members are obliquely angled away from the mating surfaces thereof.

5. The hooking clasp according to claim 1, wherein an external surface of one of said pair of flat plates includes an ornament.

* * * * *